United States Patent [19]

Smith et al.

[11] Patent Number: 4,926,748

[45] Date of Patent: May 22, 1990

[54] FRAMEWORK FOR SUPPORTING AND TYING STACKED WASTE PAPER AND NEWSPAPER

[76] Inventors: June Smith; Steve Smith, both of 177 Viewbank Crescent, Oakville, Ontario, Canada, L6L 1R3

[21] Appl. No.: 357,245

[22] Filed: May 26, 1989

[30] Foreign Application Priority Data

May 27, 1988 [CA] Canada ..... 567980

[51] Int. Cl.[5] ..... B65B 13/00

[52] U.S. Cl. ..... 100/34; 248/153

[58] Field of Search ..... 248/146, 153, 175, 499, 248/97, 99, 100, 101, 150, 176; 206/83.5, 499, 449, 555, 451, 452; 211/50; 100/34

[56] References Cited

U.S. PATENT DOCUMENTS

| | | | |
|---|---|---|---|
| 2,470,977 | 5/1949 | Chidsey, Jr. | 248/97 |
| 2,744,461 | 5/1956 | Genco | 100/34 |
| 2,818,180 | 12/1957 | Keene | 100/34 |
| 2,850,197 | 9/1958 | Hart | 100/34 |
| 3,038,403 | 6/1962 | Orelind | 100/34 |
| 3,145,646 | 8/1964 | Levy | 100/34 |
| 3,171,347 | 3/1965 | Elrod | 100/34 |
| 3,933,088 | 1/1976 | Pessagno | 100/34 |
| 4,395,941 | 8/1983 | Metzger | 100/34 |

FOREIGN PATENT DOCUMENTS

| | | | |
|---|---|---|---|
| 611219 | 5/1979 | Switzerland | 100/34 |

*Primary Examiner*—Ramon O. Ramirez
*Assistant Examiner*—Robert A. Olson
*Attorney, Agent, or Firm*—Rogers & Scott

[57] ABSTRACT

A structure to facilitate the stacking of a significant number of newspapers in a tidy manner and having means for facilitating the bundling of the newspapers stacked in the structure. In a preferred embodiment, the structure includes a framework having an open generally box-like configuration made of wire rod, a support for a supply of string or other filament, and a cutting implement to trim the string to required lengths. The framework is also provided with anchors to retain the string in an operative position ready for tying the newspapers or other paper stacked in the framework.

8 Claims, 4 Drawing Sheets

FIG.8
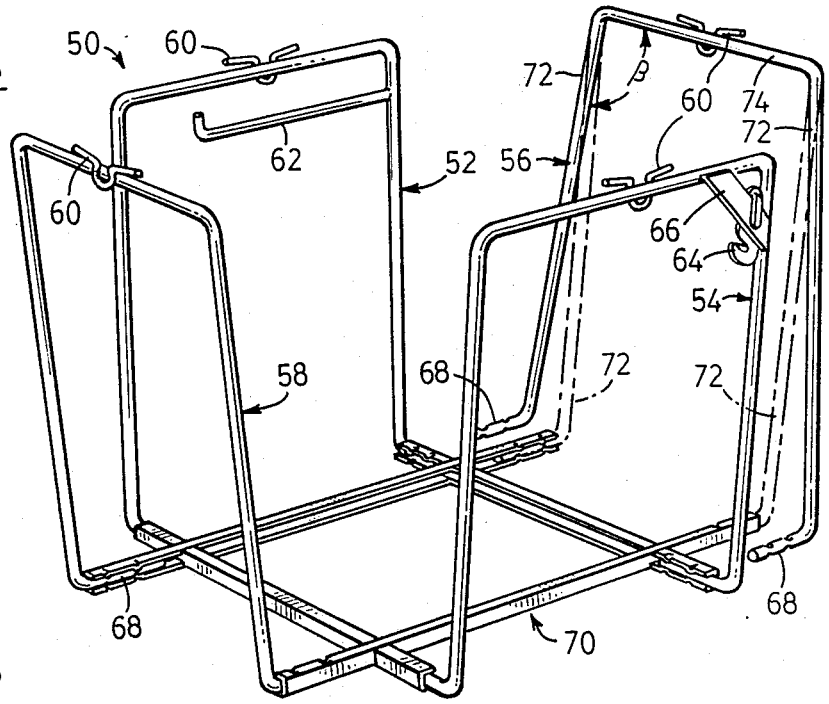
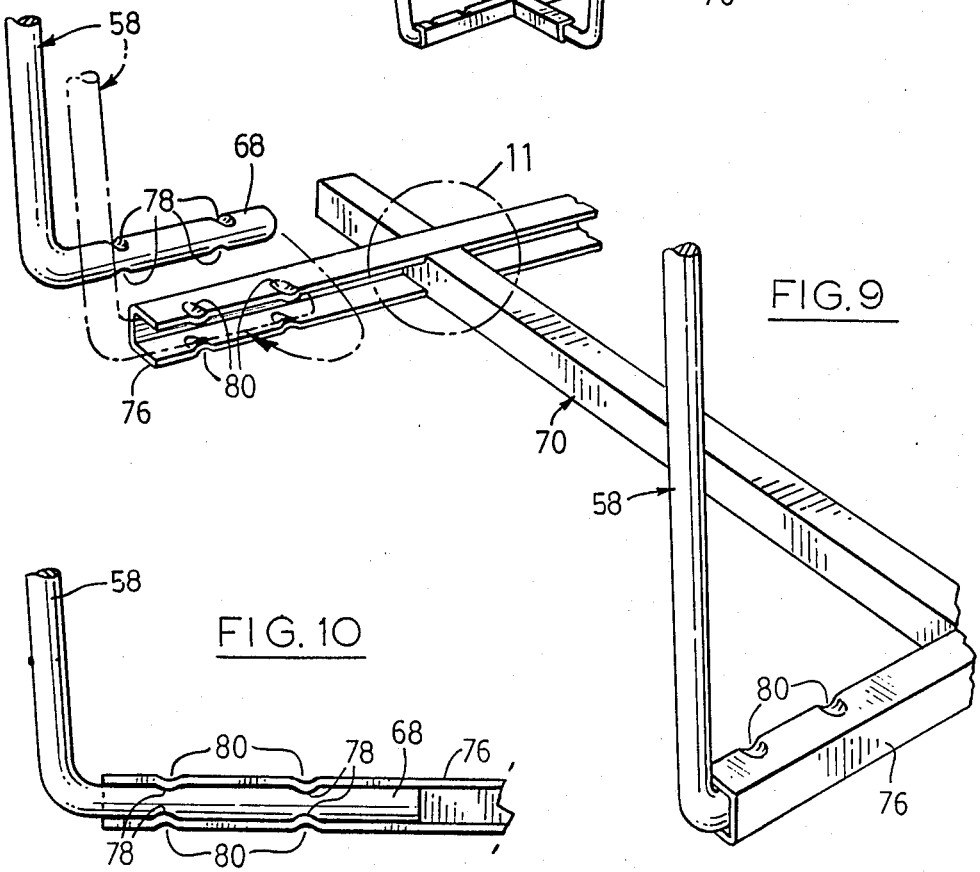
FIG.9
FIG.10

FRAMEWORK FOR SUPPORTING AND TYING STACKED WASTE PAPER AND NEWSPAPER

This invention relates to a structure for use in the temporary storage of waste paper, particularly newspaper being collected for recycling, and for facilitating the disposal of such paper.

It is now generally appreciated by the public that intelligent disposal of garbage is necessary to help in the conservation of natural resources and the protection of the environment.

This attitude has fostered an interest in sorting domestic waste into groups of materials which can be recycled for providing some of the raw materials required to make new products. In addition to conserving natural resources, this relieves some of the need to dedicate otherwise useful land to garbage landfill sites, a practice which unfortunately spoils the landscape and contributes to the pollution of groundwater. Atmospheric pollution may also be curtailed by judiciously sorting and recycling garbage to limit the amount of waste disposed of in incinerators.

One group of waste materials which is inherently recyclable is paper, in particular, newspaper. Furthermore, newspapers by their nature are bulky and inconvenient to dispose of in domestic garbage units. They thus tend to be collected in loose piles in the home until carried outside for collection and disposal by sanitation authorities. Conveniently, newspapers are sorted from other domestic waste and there is thus very little additional effort required from conservation conscious people to dispose of their newspapers in a form which is suitable for recycling.

While the practice of providing newspapers in separate form from other garbage for collection by a recycling enterprise is becoming more widespread, this practice has not been universally adopted. It is believed that the reason for this may be due in part to the difficulties which arise in collecting a significant number of newspapers in a conveniently disposable package or bundle.

As mentioned above, newspapers are usually piled loosely in the home and this results in a disorderly appearance, particularly in small homes like condominiums, apartments or townhouses. A resultant tendency in some homes is to dispose of the newspapers at short time intervals to reduce clutter. Such small bundles of newspaper may also be conveniently stuffed into used shopping bags having handles that facilitate carrying.

A problem which arises with such small bundles, unless they can be accumulated in a convenient location, is that they are placed in larger containers together with unrecyclable waste for collection and disposal on garbage day in the usual way. In some cases, a recycling business will not stop on its rounds to collect small amounts of material and annoyed occupants of the premises will dispose of the material with other waste not intended for recycling. Another problem is that several trips are required to move the packages from the home to the disposal area. Still another problem is that the shopping bags are normally made of synthetic plastic materials which have to be removed before the newspaper can be recycled.

An object of this invention is to facilitate the storage of waste paper, in particular, newspaper and its disposal to encourage those who wish to participate in recycling programs by addressing at least some of the problems discussed.

In accordance with this invention, there is provided a structure adapted to facilitate the stacking of a significant number of newspapers in a tidy manner and having means for facilitating the bundling of the newspapers so stacked for convenient carry and disposal.

A preferred embodiment of the invention is described below with reference to the accompanying drawings in which:

FIG. 8 is a similar view of FIG. 1 (drawn to a larger scale) and illustrating an alternative collapsable embodiment of the invention;

FIG. 9 is an enlarged view showing a portion of the bottom of the structure illustrated in FIG. 8;

Figure 11:
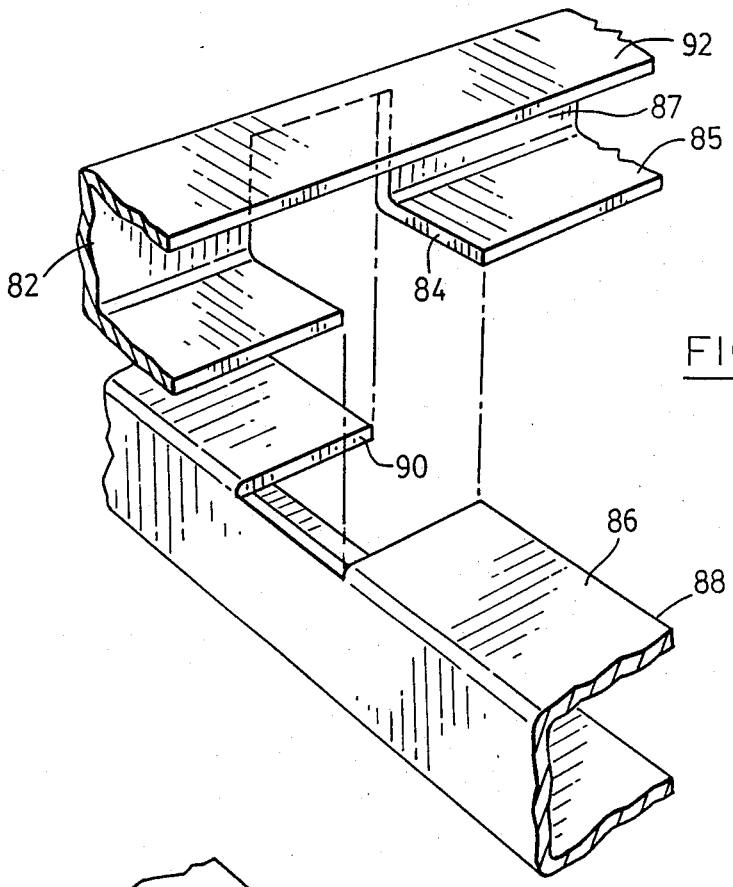
Figure 12:
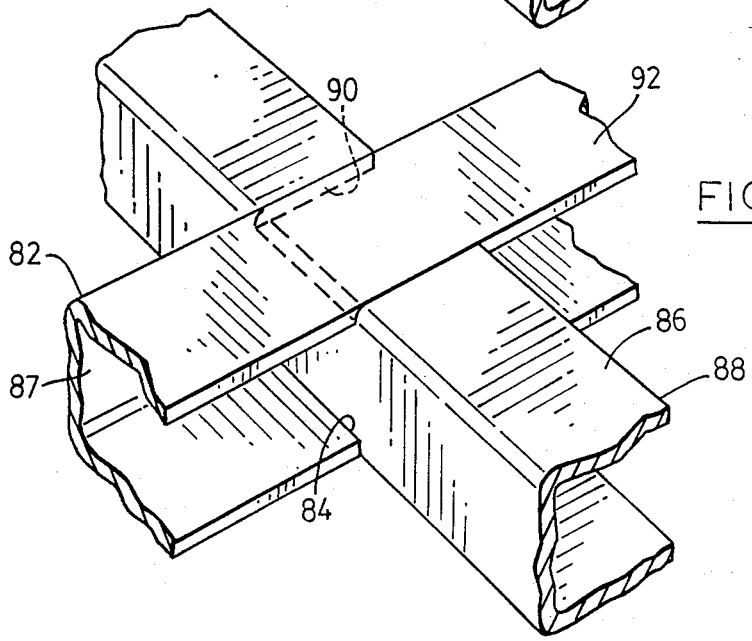

FIG. 10 (drawn to a similar scale to FIG. 9) is a side view illustrating the connection between an upstanding side and a bottom side of the structure;

FIG. 11 is an exploded view of circled area 11 in FIG. 9 and drawn to a larger scale; and FIG. 12 is a perspective view showing the components of FIG. 11 in an assembled configuration.

Figure 1:
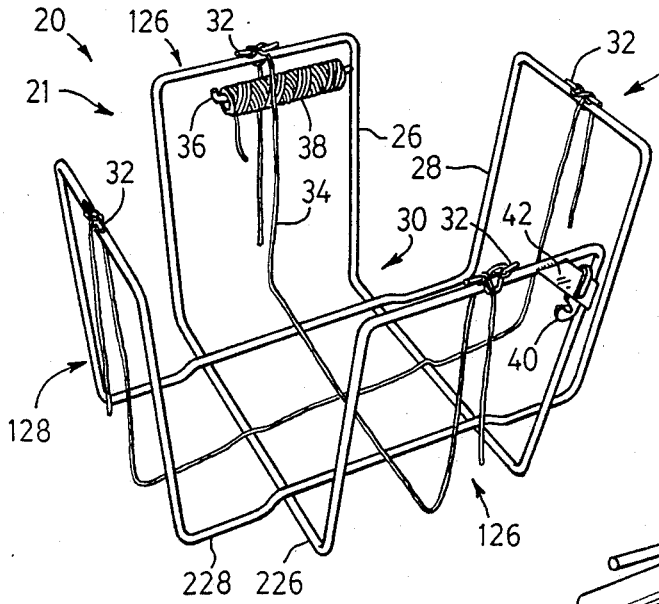
FIG. 1 is a perspective view of a structure according to the invention including a framework prepared to receive newspapers.

Referring firstly to FIG. 1, there is illustrated a structure according to the invention generally indicated by the numeral 20 and including a framework 21 made from plain carbon steel rod having a diameter of about ⅜ inch which is coated with white epoxy paint by electrostatic deposition.

The framework 21 has an open box-like configuration and has sides adapted to support and locate waste paper such as newspaper 22 (FIG. 4) being stored temporarily in a stack 24 for subsequent disposal.

The sides are formed from two lengths of rod, each of which is butt welded to form a closed rectangular shaped loop 26, 28. Each loop 26, 28 is bent upwardly to define opposite upstanding sides 126, 128 for the framework 21, intervening portions of the loop being disposed substantially horizontally to form part of a bottom side 30 for the framework located between the upstanding sides. The bottom side 30 comprises lower and upper supports 226, 228 integrally formed with the respective upstanding sides 126, 128 from the loops 26, 28 and the loops are disposed at right angles and secured at the bottom 30 by welding the lower and upper supports 226, 228 in such a way that they cross and inscribe a square. The square defines an area which is smaller than the outside dimensions of an average newspaper in a folded condition so that a stack of such newspapers can be supported on the bottom side 30 of the framework 21.

Figure 7:
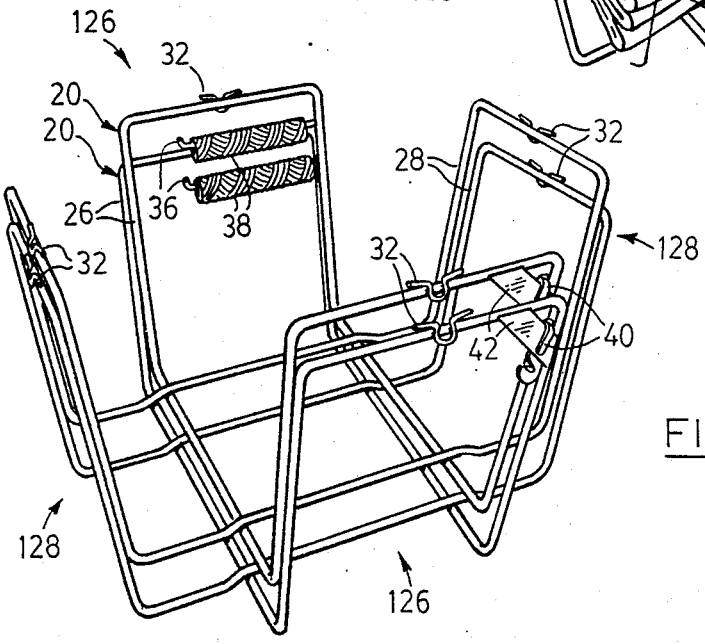
FIG. 7 is a similar view to FIG. 1 illustrating a pair of nested frameworks to show their configuration at the point of sale.

It will be appreciated that any paper of which the outside dimensions define an area smaller than the square may be supported in the stack as long as direct support is given to an operatively lower paper having sufficiently large dimensions to be supported on the bottom 30. In this way, a framework containing waste paper can be transported or moved as desired. The upstanding sides and bottom side subtend an obtuse angle so that the opening at the top end of the framework is wider than the bottom side thereby allowing a plurality of the frameworks to be nested for convenient storage during shipping and at the point of sale as seen in FIG. 7.

To increase stability of the framework 21, the upper support 228 is bent where it meets the lower support 226 so that the operatively lower surfaces of the bottom side 30 lie in a single plane.

Figure 2:
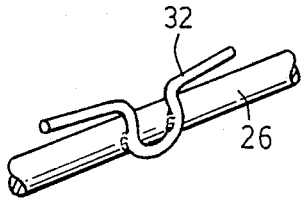
FIG. 2 is an enlarged view of a cleat provided on the framework of FIG. 1 to retain filament for tying newspapers stacked in the structure.

Each upstanding side 126, 128 is provided with an anchor in the form of a cleat 32 at an operatively upper edge. One of the cleats 32 is shown more clearly in FIG. 2 and comprises a piece of bent wire welded between its ends to the loop 26 of the framework 21. The free ends of the cleat 32 are spaced from the loop 26 a small distance adapted to a accomodate the width of string 34 provided for securing a stack of newspapers ready for removal and disposal as described more fully below.

It will be understood that any suitable filament may be used to secure a stack of newspapers and when used in this specification the word filament will include string, twine, cord and like materials.

The structure 20 further includes a horizontally extending rod 36 cantilevered at one end to the loop 26 and spaced from the operatively upper edge of the respective side 126. The rod 36 is adapted to receive and support a roll 38 that provides a ready supply of the string 34 and is hooked at its free end to prevent the roll 38 from slipping off accidentally.

Figure 3:
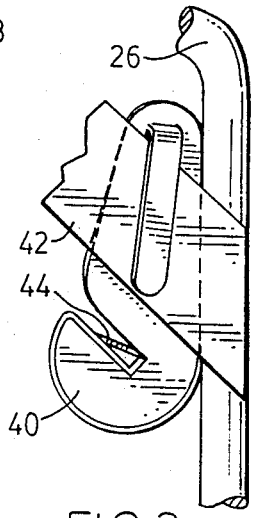
FIG. 3 is an enlarged view of a cutting implement provided to cut filament of FIG. 1.

The opposite side of the loop 26 also has a cutting implement support means and a cutting implement 40 for trimming the string 34 to required lengths. The support means is provided in the form of a flat bar 42 welded between adjacent transverse portions of the loop (FIG. 3) and the cutting implement 40 is in the form of a moulded clip which can be conveniently rested on the bar 42 and has a cutting edge 44 which is recessed within the clip for safety.

Applicants have found the following dimensions for the framework to be convenient: height of 12 inches, bottom width of 12 inches, and bottom length of 16.5 inches.

In use, the roll 38 is unravelled and two lengths of string 34 suitable for tying and securing the stack 24 are trimmed with the implement 40. Each length of string 34 is then anchored in opposite cleats 32 with the free ends of the string dangling and a median portion between the ends lying loosely on the bottom 30 of the framework 20.

Figure 4:
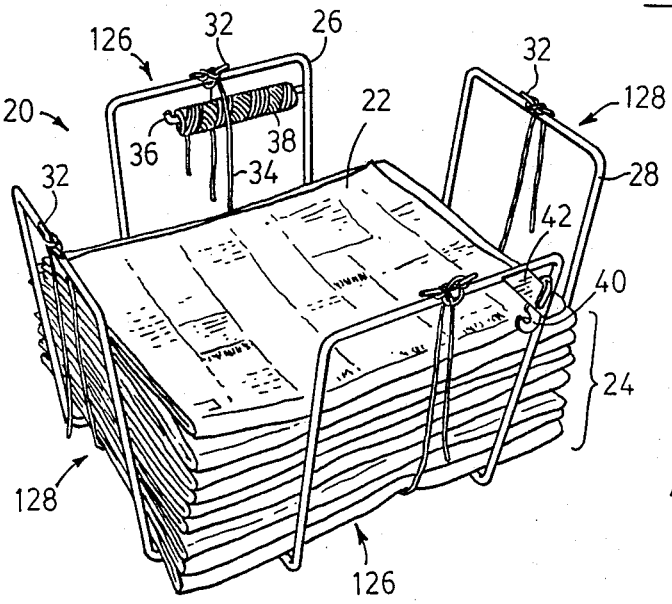
FIGS. 4 to 6 are similar views to FIG. 1 showing the structure in use.
Figure 5:
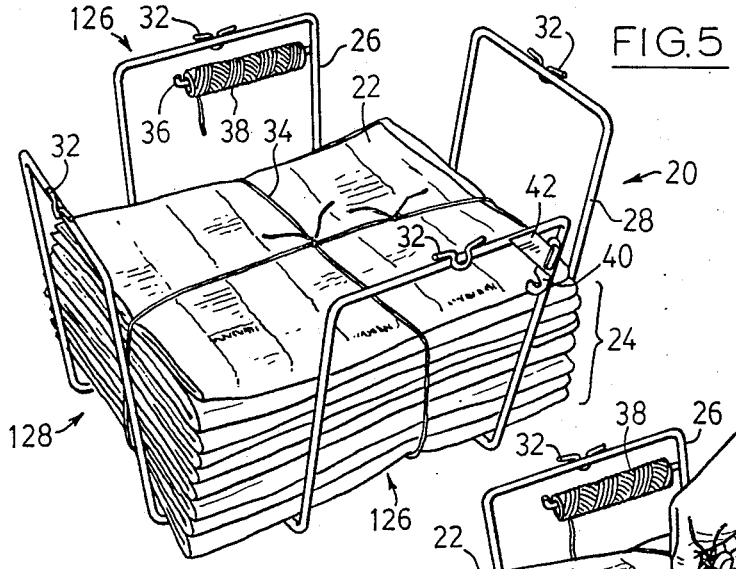
Figure 6:
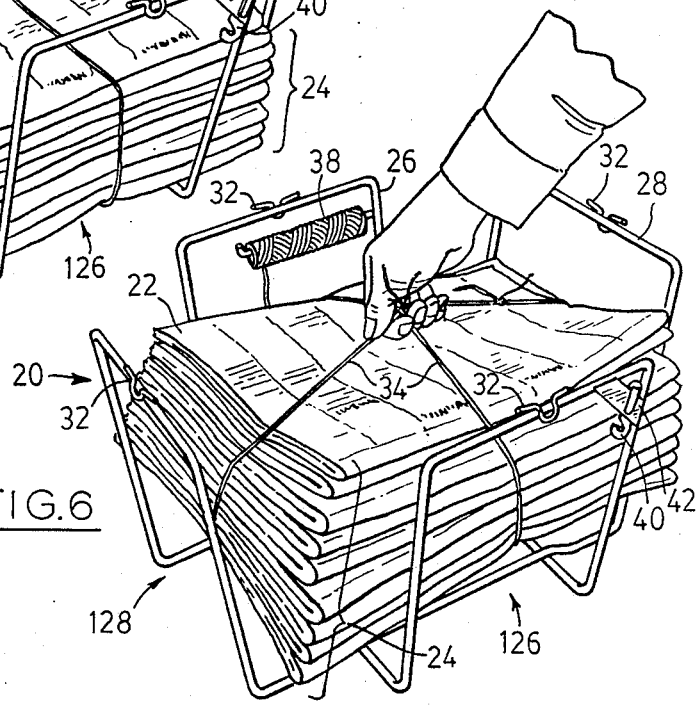

Newspapers 22 are placed on the bottom side 30 of the framework and located in a tidy stack 24 by the upstanding sides 126, 128 (FIG. 4). When the stack 24 has reached a height which the user finds convenient for handling, the lengths of string 34 are released from the cleats 32 and tied or knotted to secure the stack 24 for removal (FIG. 5). Such removal is accomplished simply by grasping the string 34 where the lengths have been tied together (FIG. 6).

It will be appreciated that the structure may be made from a variety of suitable materials as will be apparent to those skilled in the art. The framework may also be produced in a variety of sizes to accomodate newspapers or other waste paper of varying dimensions.

An alternative embodiment of the invention will be described below with reference to FIGS. 8 to 12. In this embodiment, the upstanding sides of the framework are separable from the bottom side so that the structure may be disassembled and collapsed, conveniently for mail ordered delivery.

Referring firstly to FIG. 8, it will be seen that the structure generally indicated by numeral 50 comprises two pairs of oppositely directed upstanding sides (52, 54) and (56,58) which similarly to the structure described with reference to FIG. 1 define an opening at the top to receive waste paper and are adapted to locate the paper in a stack. The sides are similarly provided with respective cleats 60 to retain filament provided for tying stacked paper in a bundle. A rod 62 similar to rod 36 is also provided for supporting a roll of filament as well as a cutting implement 64 and a support therefor 66 similar to the implement 40 and support 42 described with reference to FIG. 1.

In FIG. 8, the upstanding sides 52–58 are fabricated from lengths of wire rod. Each rod is bent at an obtuse angle so that the ends 68 of the rod extend substantially horizontally and the associated upstanding side has a substantially inverted U-shape.

The ends 68 are adapted for substantially horizontal location into respective openings provided in a bottom side generally indicated by numeral 70.

With reference to the right-hand side of the drawing of FIG. 8, it will be seen that the side 56 when removed from the structure as drawn in solid outline, is wider at the bottom than at the top since the angle between the upstanding legs 72 of the U-shaped side and the associated upper connecting portion 74 subtend an obtuse angle indicated by $\beta$.

The bottom side 70 is fabricated from four pieces of channel shaped tubing 76 open on one side and arranged to form a grid with the ends overlapping and oriented with the open side directed inwardly so as to receive and retain a respective end 68 of the associated upstanding side.

As indicated by the arrow in FIG. 9, the ends 68 are laterally inserted into the tubing 76. The connection between the upstanding sides and the bottom side is secured by means of notches 78 provided in the ends 68 and adapted to cooperate with corresponding dimples 80 formed in the tubing 76 (FIG. 10).

Oppositely directed channels 76 comprising the bottom side 70 are spaced from each other a distance which is less than the distance separating the ends 68 of the sides when removed from the structure so that when the structure is assembled, the ends 68 are retained by the channel-shaped tubing in an inwardly biased configuration as indicated in ghost outline at the right hand side of the drawing of FIG. 8.

Referring now to FIG. 11 and FIG. 12, it will be seen that the channel-shaped tubing 76 is cutaway at the junction between superimposed members comprising the bottom side 70 so as to present a flush surface, the operatively upper tubing member 82 having an L-shaped cut 84 corresponding to a lower flange 85 and upstanding flange 87 of the channel and a width adapted to bridge the upper flange 86 of the associated lower member 88.

The upper flange 86 of the associated lower member 88 has a cut 90 of sufficient width and depth to accommodate the upper flange 92 of the upper member 82.

What is claimed is:

1. Structure for the temporary storage of waste paper, the structure comprising two pairs of upstanding sides adapted to locate paper in a stack, and a bottom side to support the stack, the upstanding sides having respective anchor means to retain the ends of filament for securing said stack in a bundle, each pair of upstanding sides being fabricated from respective lengths of wire rod of which the ends are joined to form a closed substantially rectangular loop, each loop being bent upwardly at opposite ends to define said upstanding sides, and intervening portions of the loops being disposed one above the other at right angles to each other to define upper and lower supports comprising said bottom side, the upper support being bent upwardly and horizontally where it meets the lower support so that the structure has an operatively lower surface which lies in a single plane.

2. Structure according to claim 1 including filament support means for a supply of filament.

3. Structure according to claim 1 including cutting implement support means for a cutting implement to trim the filament to suitable lengths.

4. Structure according to claim 1 in which the loops are bent so that the upstanding sides and bottom side subtend an obtuse angle thereby allowing a plurality of the structures to be nested.

5. Structure for the temporary storage of waste paper, the structure comprising two pairs of upstanding sides adapted to locate paper in a stack and a bottom side to support the stack, the upstanding sides having respective anchor means to retain the ends of filament for securing said stack in a bundle, and the upstanding sides being separable from the bottom side so that the structure may be disassembled and collapsed, each of the upstanding sides being fabricated from a length of wire rod bent into a substantially inverted U-shape configuration lying in a first substantially vertical plane of which the ends are each bent toward the center of the structure to lie in a second substantially horizontal plane, the bottom side being fabricated from four lengths of channel shaped tubing open on one side and having a substantially C-shaped cross-section, the tubing being disposed substantially horizontally to inscribe a quadrilateral, and oriented with the open side facing the center of the structure so as to be adapted to receive the ends of the upstanding sides by lateral insertion, the separation between the ends of the upstanding sides being greater than the separation between the associated tubing so that said ends are retained in the tubing in an inwardly biased configuration.

6. Structure according to claim 5 in which the tubing is dimpled for cooperation with corresponding notches provided in the ends of the upstanding sides.

7. Structure according to claim 5 including filament support means for a supply of filament.

8. Structure according to claim 5 including cutting implement support means for a cutting implement to trim the filament to suitable lengths.

* * * * *